US012342856B1

(12) United States Patent
Liu et al.

(10) Patent No.: US 12,342,856 B1
(45) Date of Patent: Jul. 1, 2025

(54) ATOMIZATION APPARATUS AND AEROSOL GENERATING APPARATUS

(71) Applicant: Shenzhen Woody Vapes Technology Co., Ltd., Guangdong (CN)

(72) Inventors: Youming Liu, Guangdong (CN); Yunyun Duan, Guangdong (CN)

(73) Assignee: Shenzhen Woody Vapes Technology Co., Ltd., Shenzhen (CN)

( * ) Notice: Subject to any disclaimer, the term of this patent is extended or adjusted under 35 U.S.C. 154(b) by 0 days.

(21) Appl. No.: 18/882,875

(22) Filed: Sep. 12, 2024

(30) Foreign Application Priority Data

Dec. 29, 2023 (CN) ..... 202323666459.9

(51) Int. Cl.

| | |
|---|---|
| ***A24F 13/00*** | (2006.01) |
| ***A24F 40/10*** | (2020.01) |
| ***A24F 40/30*** | (2020.01) |
| ***A24F 40/44*** | (2020.01) |
| ***A24F 40/46*** | (2020.01) |
| ***A24F 40/485*** | (2020.01) |

(52) U.S. Cl.
CPC ..... *A24F 40/30* (2020.01); *A24F 40/10* (2020.01); *A24F 40/44* (2020.01); *A24F 40/46* (2020.01); *A24F 40/485* (2020.01)

(58) Field of Classification Search
CPC ..... A24F 47/00
USPC ..... 131/328–329
See application file for complete search history.

(56) References Cited

U.S. PATENT DOCUMENTS

| | | | | |
|---|---|---|---|---|
| 9,271,528 | B2 * | 3/2016 | Liu | A61M 11/042 |
| 10,966,456 | B1 * | 4/2021 | Hermiz | H02J 7/0063 |
| 12,114,694 | B2 * | 10/2024 | Bruton | A24F 40/485 |
| 2024/0315347 | A1 * | 9/2024 | Li | G08B 21/12 |

OTHER PUBLICATIONS

Notice of Granting Utility Model Patent Right Dated Aug. 12, 2024 From the State Intellectual Property Office of the People's Republic of China Re. Application No. 202323666459.9 and Its Translation Into English. (4 Pages).

* cited by examiner

*Primary Examiner* — Phuong K Dinh

(57) ABSTRACT

An atomization apparatus and an aerosol generating apparatus is provided. The atomization apparatus includes a vapor guiding structure in which a first vapor discharging channel and a second vapor discharging channel are formed; and a vapor gathering structure being in communication with both the first vapor discharging channel and the second vapor discharging channel and in which a vapor discharging port is formed, the vapor gathering structure being used for gathering the vapor passing through the first vapor discharging channel and the vapor passing through the second vapor discharging channel, and guiding the gathered vapor discharged from the vapor discharging port, the first vapor discharging channel includes a first end facing the vapor discharging port, and the second vapor discharging channel includes a second end facing the vapor discharging port.

19 Claims, 8 Drawing Sheets

ATOMIZATION APPARATUS AND AEROSOL GENERATING APPARATUS

CROSS-REFERENCE TO RELATED APPLICATION

This application claims the benefit of priority of Chinese Application No. 202323666459.9, filed on Dec. 29, 2023, the contents of which are incorporated by reference as if fully set forth herein in their entirety.

TECHNICAL FIELD

This disclosure belongs to the technical field of atomization apparatus, and more particularly, to an atomization apparatus and an aerosol generating apparatus.

BACKGROUND

An atomization apparatus can convert a substance to be atomized into an aerosol medium in the form of vapor by heating, and is widely used in medical treatment, burned coal atomization, electronic cigarettes and other fields. However, the vapor produced by a conventional atomization apparatus has a single taste, which leads to a poor user experience. Consequently, an atomization apparatus with two atomization cores was developed. The two atomization cores can be used with substances to be atomized with different tastes to produce vapor with different tastes. The vapor with two different tastes are finally inhaled by a user.

However, there is often a problem with the vapor produced by the two atomization cores respectively, that is, the two streams of vapor are not mixed well, and even the two streams of vapor impact inner walls of a mouth on both sides. Thus, the taste of the vapor is bad, the aroma is not rich enough, and the user experience is poor.

SUMMARY

An embodiment of the present disclosure provides an atomization apparatus and an aerosol generating apparatus, so that the experience of vapor dispersion caused by multiple streams of vapor impacting inner walls of a mouth on both sides can be avoided.

According to a first aspect, an embodiment of the present disclosure provides an atomization apparatus including:

a vapor guiding structure, in which a first vapor discharging channel and a second vapor discharging channel being formed; and a vapor gathering structure being in communication with both the first vapor discharging channel and the second vapor discharging channel, and in which a vapor discharging port being formed, the vapor gathering structure being configured to gather vapor passing through the first vapor discharging channel and vapor passing through the second vapor discharging channel, and guide a gathered vapor to be discharged from the vapor discharging port;

wherein, the first vapor discharging channel includes a first end facing the vapor discharging port, the second vapor discharging channel includes a second end facing the vapor discharging port, a cross-sectional area of the first end gradually decreases in a direction away from the vapor discharging port, and a cross-sectional area of the second end gradually decreases in the direction away from the vapor discharging port.

According to a second aspect, an embodiment of the present disclosure further provides an aerosol generating apparatus, including the atomization apparatus of any one of the above embodiments and a power supply apparatus being electrically connected to the atomization apparatus.

In the atomization apparatus according to an embodiment of the present disclosure, the cross-sectional area of the first end is configured to be gradually decreased in a direction away from the vapor discharging port and the cross-sectional area of the second end is configured to be gradually decreased in a direction away from the vapor discharging port, so that one stream of vapor flows along the first vapor discharging channel and enters the vapor gathering structure through the first end, and another stream of vapor flows along the second vapor discharging channel and enters the vapor gathering structure through the second end. The closer the two streams of vapor flow to the vapor discharging port, the smaller the distance between the two streams of vapor is, and the larger the amount of vapor is. After flowing to the vapor gathering structure, the two streams of vapor can be gathered and mixed at a larger extend, and thus the experience of vapor dispersion caused by two streams of vapor impacting inner walls of a mouth on both sides can be avoided. The vapor discharged from the vapor discharging port is gathered and concentrated, allowing the user to have a rich and concentrated vapor inhaling experience, which improves the user experience.

BRIEF DESCRIPTION OF THE DRAWINGS

In order that the technical solutions in the embodiments of the present disclosure may be explained more clearly, a brief description will be given below to the accompanying drawings required in the description of the embodiments. Obviously, the drawings in the following description merely illustrate some of the embodiments of the present disclosure, and for those skilled in the art, other drawings can be made from these drawings without involving any inventive effort.

For the sake of a more complete understanding of the present disclosure and its beneficial effects, reference will now be made to the accompanying drawings. In the following descriptions, same reference numerals refer to same parts.

DETAILED DESCRIPTION

The technical solution in the embodiments of the present disclosure will be clearly and completely described with reference to the accompanying drawings. It will be apparent that the described embodiments are only part of the examples of the present disclosure, and not all examples. Based on the embodiments in the present disclosure, all other embodiments obtained by a person skilled in the art without involving any inventive effort are within the scope of the present disclosure.

The atomization apparatus can, convert a substance to be atomized into an aerosol medium in the form of vapor by heating, and is widely used in medical treatment, burned coal atomization, electronic cigarettes and other fields. However, the vapor produced by a conventional atomization apparatus has a single taste, which leads to a poor user experience. Consequently, an atomization apparatus with two atomization cores was developed. The two atomization cores can be used with substances to be atomized with different tastes to produce vapor with different tastes. The vapor with two different tastes are finally inhaled by a user. However, there is often a problem with the vapor produced by the two atomization cores respectively, that is the two streams of vapor are not mixed well, and even the two streams of vapor impact inner walls of a mouth on both sides. Thus, the taste of the vapor is bad, the aroma is not rich enough, and the user experience is poor.

In order to solve the above technical problems, embodiments of the present disclosure provide an atomization apparatus. It should be noted that vapor in the embodiments of the present disclosure mainly refer to an aerosol medium in the form of vapor that is converted from a substance to be atomized by heating. The substance to be atomized may include a substance to be atomized in liquid form or a substance to be atomized in solid form. The atomization apparatus may include a plurality of atomization assemblies. In a case where the substance to be atomized is in liquid form, each atomization assembly may include a heating wire, a liquid storage cotton, and other structures. The substance to be atomized in the liquid storage cotton can be atomized by heating of the heating wire, so that vapor is produced. Each atomization assembly may correspond to a vapor discharging channel, so that vapor generated by either one atomization assembly may be guided to be discharged from its corresponding vapor discharging channel.

Figure 1:
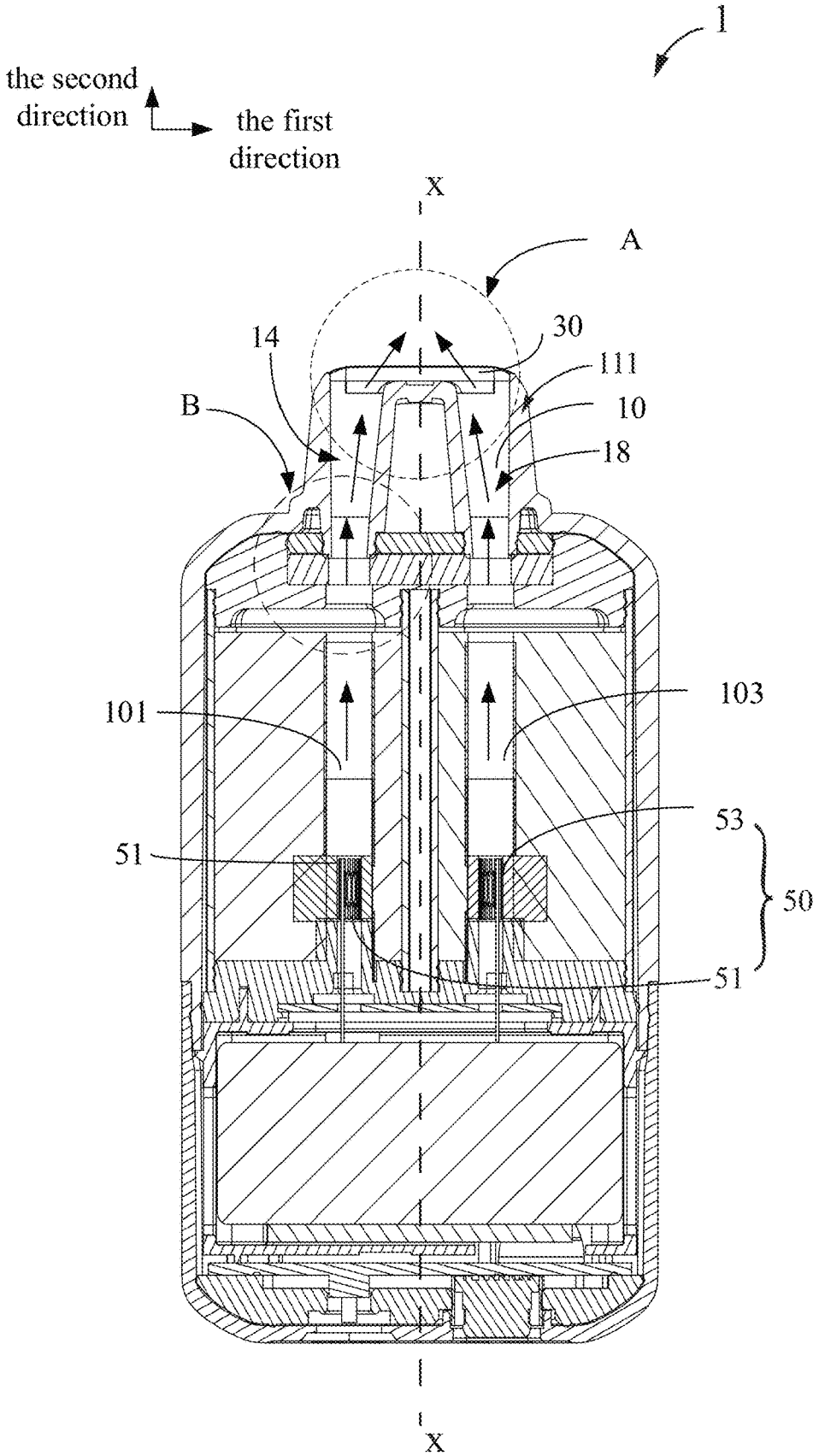
FIG. 1 is a cross-sectional view of an atomization apparatus according to an embodiment of the present disclosure.

FIG. 1 illustrates a cross-sectional view of an atomization apparatus according to an embodiment of the present disclosure, and flow directions of streams of vapor in the atomization apparatus are indicated by arrows. The atomization apparatus 1 includes a vapor guiding structure 10 and a vapor gathering structure 30. A plurality of vapor discharging channels for guiding multiple streams of vapor to the vapor gathering structure 30 may be formed in the vapor guiding structure 10, so that the multiple streams of vapor gather at the vapor gathering structure 30.

Figure 2:
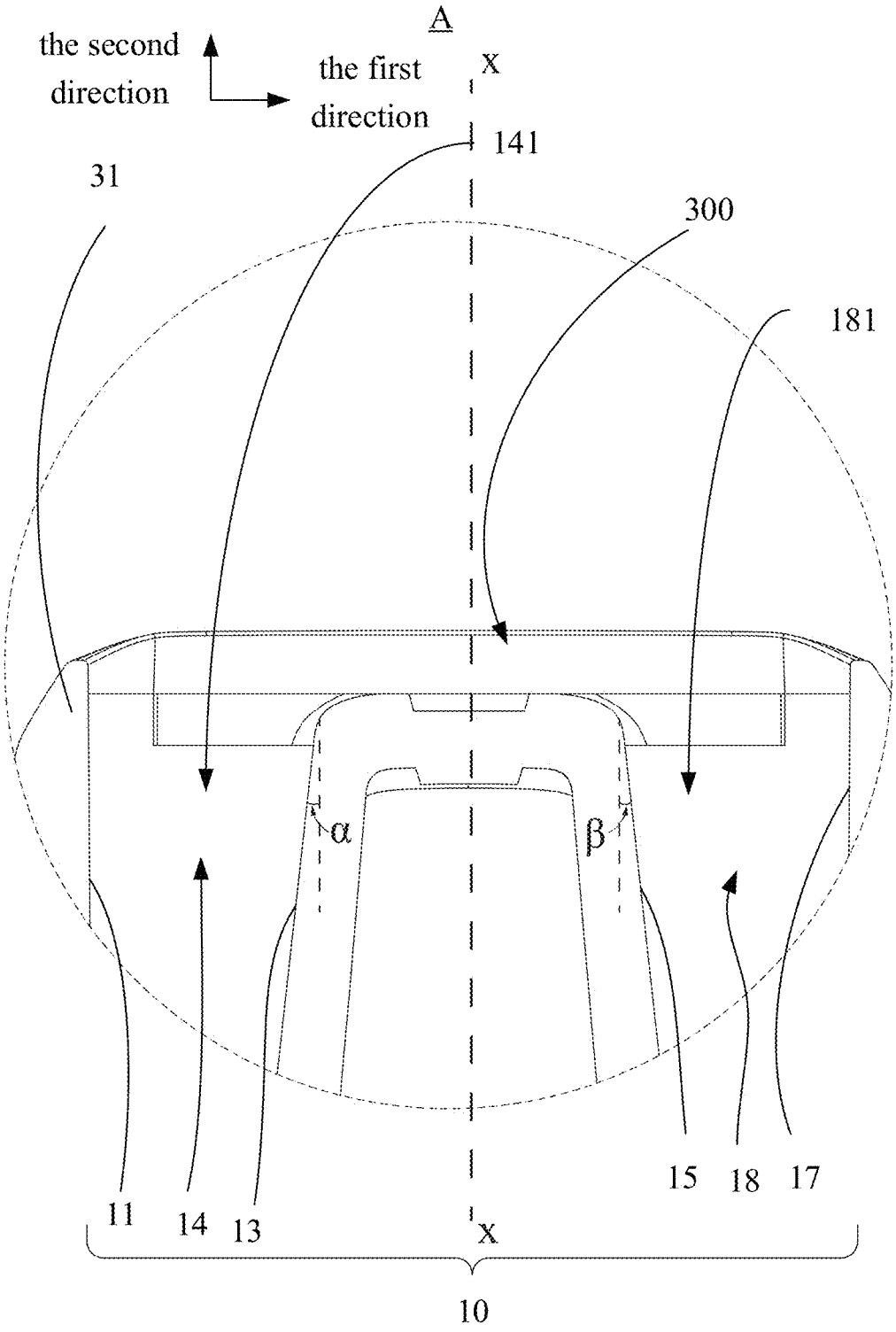
FIG. 2 is a partially enlarged view of part A in FIG. 1.

Specifically, a first vapor discharging channel 14 and a second vapor discharging channel 18 may be formed in the vapor guiding structure 10. The first vapor discharging channel 14 may correspond to an atomization assembly, and is configured to guide vapor generated by the atomization assembly. The second vapor discharging channel 18 may correspond to another atomization assembly, and is configured to guide vapor generated by the another atomization assembly. Referring to FIG. 2, the vapor gathering structure 30 may be in communication with both the first vapor discharging channel 14 and the second vapor discharging channel 18. A vapor discharging port 300 is arranged at the vapor gathering structure 30. The vapor gathering structure 30 is configured for gathering the vapor passing through the first vapor-discharging channel 14 and the vapor passing through the second vapor-discharging channel 18 together, and discharging the gathered vapor from the vapor discharging port 300. That is, one stream of vapor generated by one atomization assembly is guided to the vapor gathering structure 30 through its corresponding first vapor discharging channel 14, and another stream of vapor generated by the another atomization assembly is guided to the vapor gathering structure 30 through its corresponding second vapor discharging channel 18. The two streams of vapor can gather at the vapor gathering structure 30 through the first vapor discharging channel 14 and the second vapor discharging channel 18.

The first vapor discharging channel 14 includes a first end 141 facing the vapor discharging port 300, and the second vapor discharging channel 18 includes a second end 181 facing the vapor discharging port 300. To improve the gather of the two streams of vapor, the cross-sectional area of the first end 141 gradually decreases in a direction away from the vapor discharging port 300, and the cross-sectional area of the second end 181 gradually decreases in a direction away from the vapor discharging port 300. In this way, one stream of vapor flows along the first vapor discharging channel 14 and enters the vapor gathering structure 30 through the first end 141, and the another stream of vapor flows along the second vapor discharging channel 18 and enters the vapor gathering structure 30 through the second end 181. The closer the two streams of vapor flow to the vapor discharging port, the smaller the distance between the two streams of vapor is, and the larger the amount of the vapor is. After flowing to the vapor gathering structure 30, the two streams of vapor can be gathered and mixed to a larger extend, and thus the experience of vapor dispersion caused by two streams of vapor impacting inner walls of a mouth on both sides can be avoided. The vapor discharged from the vapor discharging port 300 is gathered and concentrated, allowing the user to have a rich and concentrated vapor inhaling experience, which improves the user experience.

Referring to FIG. 2, the vapor guiding structure 10 includes a first side wall 11, a second side wall 13, a third side wall 15, and a fourth side wall 17. As indicated in FIG. 2, a first direction is generally perpendicular to a second direction, which is generally an axial direction of the atomization apparatus. The first side wall 11, the second side wall 13, the third side wall 15, and the fourth side wall 17 are arranged substantially in the first direction. The first side wall 11 and the fourth side wall 17 are disposed opposite to each other. It should be noted that the arrangement of the first side wall 11 being opposite to the fourth side wall 17 does not necessarily mean that the first side wall 11 must be arranged in parallel with the fourth side wall 17, instead, the first side wall 11 and the fourth side wall 17 may not be parallel to each other. For example, in some embodiments, the first side wall and the second side wall may be curved surfaces extending along an axis x-x of the atomization apparatus. The first side wall 11 and the fourth side wall 17 substantially extend in a first direction. The second side wall 13 and the third side wall 15 are disposed between the first side wall 11 and the fourth side wall 17. The second side wall 13 is disposed obliquely from the vapor gathering structure 30 toward a direction away from the vapor gathering structure 30 and toward a direction away from the fourth side wall 17. The third side wall 15 is disposed obliquely from the vapor gathering structure 30 toward a direction away from the vapor gathering structure 30 and toward a direction away from the first side wall 11. The first vapor discharging channel 14 is formed by the first side wall 11 and the second side wall 13, and the second vapor discharging channel 18 is formed by the third side wall 15 and the fourth side wall 17. Thus, the first vapor discharging channel 14 formed by the first side wall 11 and the second side wall 13 is arranged obliquely toward the fourth side wall 17 and extends along the second direction, and the second vapor discharging channel 18 formed by the third side wall 15 and the fourth side wall 17 is arranged obliquely toward the first side wall 11 and extends along the second direction. Thus, the closer the first vapor discharging channel 14 and the second vapor discharging channel 18 extend toward the vapor discharging port 300, the smaller the distance between the first vapor discharging channel 14 and the second vapor discharging channel 18 is. The distance between the first vapor discharging channel 14 and the second vapor discharging channel 18 is the smallest at a side close to the vapor discharging port 300, so as to facilitate the vapor discharged from the first vapor discharging channel 14 and the vapor discharged from the second vapor discharging channel 18 gathering at the vapor gathering structure 30.

In some specific embodiments, an angle α between the second side wall 13 and the axis x-x of the atomization apparatus may be set to be 6 degrees~10 degrees, such as 6 degrees, 7 degrees, 8 degrees, 9 degrees, or 10 degrees. An angle β between the third side wall 15 and the axis x-x of the atomization apparatus may be 6 degrees~10 degrees, for example, 6 degrees, 7 degrees, 8 degrees, 9 degrees, or 10 degrees. The angle α between the second side wall 13 and the axis x-x of the atomization apparatus is equal in size to the angle β between the third side wall 15 and the axis x-x of the atomization apparatus. Alternatively, the angle α between the second side wall 13 and the axis x-x of the atomization apparatus may be set to be different in size from the angle β between the third side wall 15 and the axis x-x of the atomization apparatus, according to actual requirements.

Figure 6:
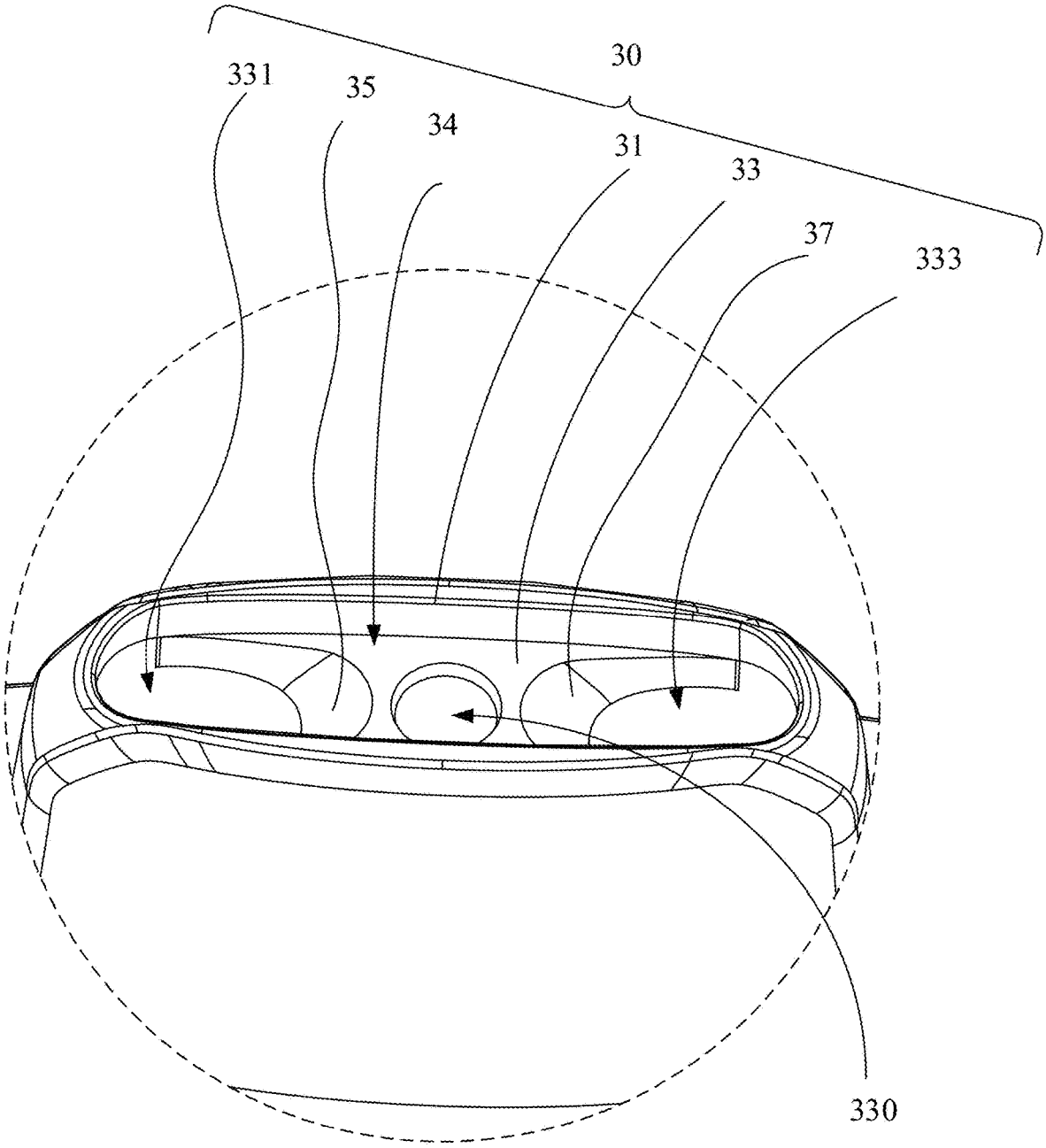
FIG. 6 is a partially enlarged view of part C in FIG. 5.

Referring to FIGS. 2 and 6, a vapor gathering space is formed in the vapor gathering structure 30, the vapor discharged from the first vapor-discharging channel 14 and the vapor discharged from the second vapor-discharging channel 18 gather at the vapor gathering space. The vapor gathering structure 30 may include an annular convex edge 31 and a bottom wall 33. One end of the annular convex edge 31 is connected to the bottom wall 33, and an opposite end of the annular convex edge 31 extends in a direction away from the bottom wall to form the vapor discharging port. A first vapor inlet opening 331 and a second vapor inlet opening 333 are formed at intervals in the bottom wall 33. The first vapor discharging channel is in communication with the vapor gathering space 34 through the first vapor inlet opening 331, and the second vapor discharging channel is in communication with the vapor gathering space 34 through the second vapor inlet opening 333. The vapor in the first vapor discharging channel 14 enters the vapor gathering space 34 through the first vapor inlet opening 331, and the vapor in the second vapor discharging channel enters the vapor gathering space 34 through the second vapor inlet opening 333. The two streams of vapor gather together at the vapor gathering space. The two streams of vapor gather and mix in the vapor gathering space. The annular convex edge 31 facilitates further improving the gathering effect, thereby providing the user with a better inhaling experience.

Figure 7:
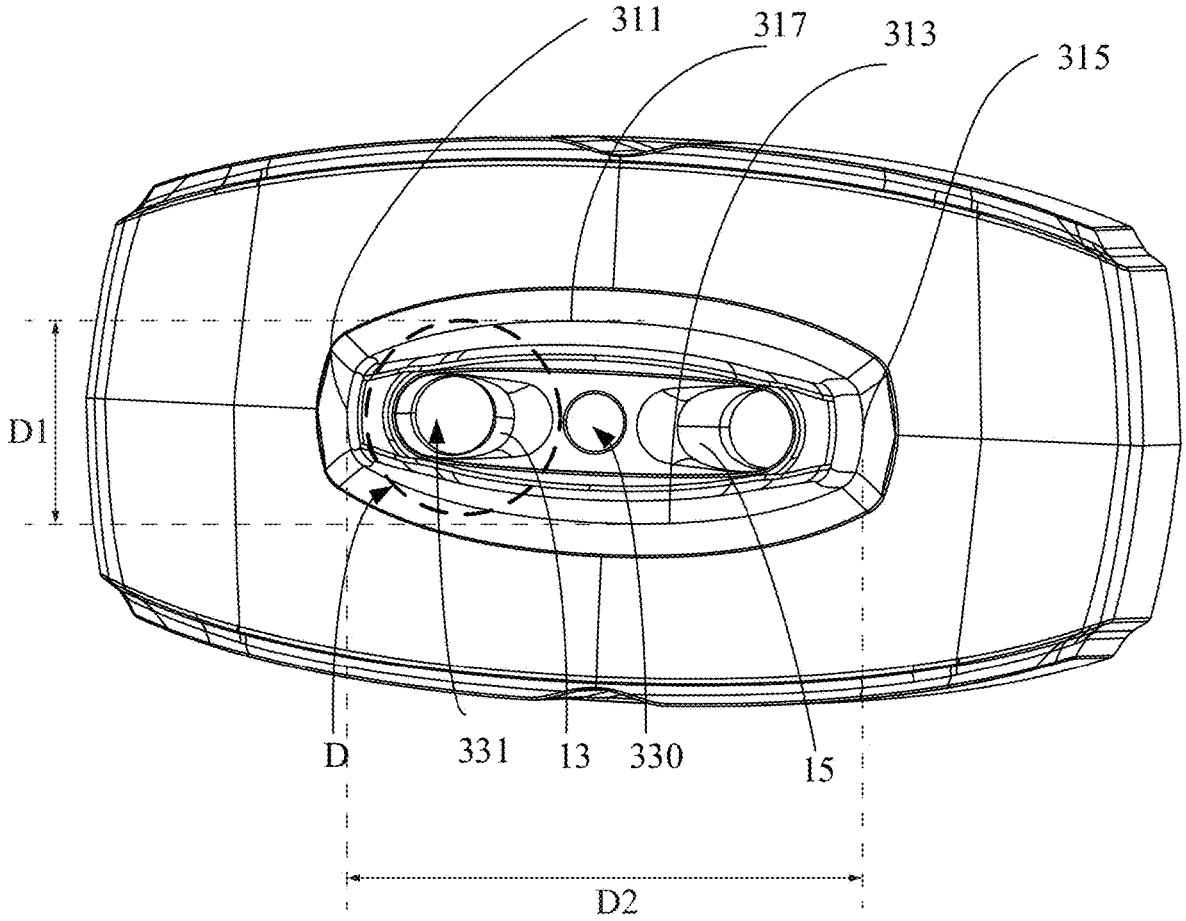
FIG. 7 is a top view of FIG. 5.
Figure 8:
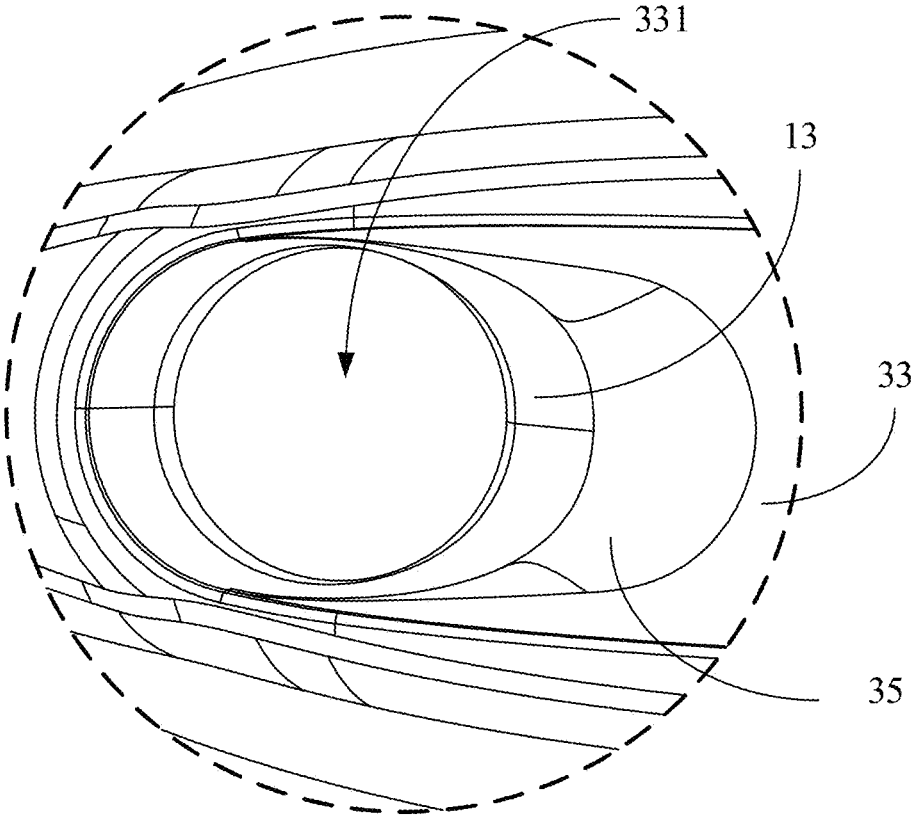
FIG. 8 is a partially enlarged view of part D in FIG. 7

Referring to FIGS. 6, 7 and 8, in order to further improve the gathering effect of multiple streams of vapor, the vapor gathering structure 30 of the atomization apparatus further includes a first guiding wall 35 connected between the second side wall 13 and the bottom wall 33. The first guiding wall 35 extends obliquely from the second side wall 13 to the bottom wall in a direction toward the fourth side wall 17 so as to guide the vapor in the first channel toward the direction close to the second vapor-discharging channel 18. As can be seen from FIG. 6, an angle between the first guiding wall 35 and the axis x-x of the atomization apparatus is greater than the angle α between the second side wall 13 and the axis x-x of the atomization apparatus. In other words, compared to the second side wall 13, the first guiding wall 35 has a greater inclination angle toward the fourth side wall. Thus, when passing through the first guiding wall 35, the vapor is guided closer to the fourth side wall, i.e. the vapor is closer to the vapor discharged from the second vapor discharging channel. As a result, the two streams of vapor gather better in the vapor gathering structure 30, improving the user experience.

Referring to FIGS. 5, 6, 7 and 8, the vapor gathering structure 30 further includes a second guiding wall 37 connected between the third side wall 15 and the bottom wall. The second guiding wall 37 extends obliquely from the third side wall to the bottom wall in a direction toward the first side wall, so as to guide the vapor in the second channel toward the direction close to the first vapor discharging channel. As can be seen from FIG. 6, an angle between the second guiding wall 37 and the axis x-x of the atomization apparatus is greater than the angle β between the third side wall and the axis x-x of the atomization apparatus. That is, compared to the third side wall, the second guiding wall 37 has a greater inclination angle toward the first side wall. As a result, when passing through the second guide wall, the vapor is guided closer to the first side wall. The vapor is guided closer to the vapor discharged from the first vapor discharging channel, thereby improving the user experience.

In some specific embodiments, the angle between the first guiding wall 35 and the axis x-x of the atomization apparatus is the same in size as the angle between the second guiding wall 37 and the axis x-x of the atomization apparatus.

Referring to FIGS. 1 and 7, in use of the atomization apparatus, the user generally places the end where the vapor gathering structure 30 is located into his mouth for inhalation. Therefore, in order to prevent the vapor from leakage and thereby provide the user with a better inhaling experience, the shape of the vapor gathering structure 30 can be designed according to the shape of the mouth. Specifically, the annular convex edge 31 may include a first convex edge 311, a second convex edge 313, a third convex edge 315, and a fourth convex edge 317, which are connected in sequence. The first convex edge 311 is disposed opposite to the third convex edge 315, and the second convex edge 313 is disposed opposite to the fourth convex edge 317. The distance D1 between the second convex edge 313 and the fourth convex edge 317 is smaller than the distance D2 between the first convex edge 311 and the third convex edge 315. As a result, the overall shape of the annular convex edge is relatively flat, which can fit the shape of the mouth well, making the vapor difficult to leak and disperse, enabling a better gathering of the vapor in the mouth, and thus improving the user experience.

Referring to FIG. 7, furthermore, a groove 330 is formed in the bottom wall 33, the groove 330 is located between the first vapor inlet opening and the second vapor inlet opening. By forming the groove 330 between the first vapor inlet opening and the second vapor inlet opening, on one hand, the vapor entering the vapor gathering structure 30 passes through the groove 330, and impact with the groove 330, which is conducive to the gathering of the vapor, and on the other hand, the groove 330 can be used to collect condensate. It will be readily understood that, during the process of guiding the vapor to be discharged from the vapor discharging channels, the temperature of the vapor discharging channels is lower than that at the heating wire, and thus some of the vapor may be changed into the form of condensate due to the decrease in temperature. Although it is referred to herein as condensate, it does not mean that the temperature thereof is acceptable to the user, the temperature of the condensate may exceed the user's acceptable level or even burn the user. Therefore, the formation of the groove 330 is conductive to collect the condensate and thus avoid the condensate from being inhaled by the user. Therefore, the user would not be burned and the taste of the vapor is improved, and thereby the user experience is improved. Furthermore, the formation of the groove 330 is conductive to injection molding process.

Referring to FIG. 1, the atomization apparatus further includes an atomization assembly 50, and a first channel 101 and a second channel 103 located at the side, away from the vapor gathering structure 30, of the vapor guiding structure 10. The atomization assembly 50 includes a first atomization assembly 51 and a second atomization assembly 53. The first channel 101 is in communication with the first vapor discharging channel 14, and the second channel 103 is in communication with the second vapor discharging channel 18. The first atomization assembly 51 is mounted in the first channel 101, and the second atomization assembly 53 is mounted in the second channel 103.

Specifically, the first atomization assembly 51 may include a heating wire, a liquid storage cotton, and other structures, and may further include an oil cup. Liquid substance to be atomized in the oil cup enters the liquid storage cotton, and the liquid substance to be atomized in the liquid storage cotton is heated by the heating wire, so that the substance to be atomized is converted into vapor for inhalation by the user. In a case where the substance to be atomized is in solid form, the substance to be atomized in solid form can be converted into vapor by electromagnetic heating or other methods for inhalation by the user. The structure of the second atomization assembly 53 may be the same as that of the first atomization assembly 51. In order to enrich the taste of the vapor inhaled by the user, the substance to be atomized in the oil cup of the first atomization assembly 51 may be different in taste from that in the oil cup of the second atomization assembly 53. For example, the substance to be atomized in the oil cup of the first atomization assembly 51 may be strawberry-flavored, and the substance to be atomized in the oil cup of the second atomization assembly 53 may be blueberry-flavored. The embodiments of the subject disclosure are not limited thereto.

The vapor generated by the first atomization assembly 51 enters the vapor gathering structure 30 through the first channel 101 and the first vapor discharging channel 14, and the vapor generated by the second atomization assembly 53 enters the vapor gathering structure 30 through the second channel 103 and the second vapor discharging channel 18. The two streams of vapor, that is, the vapor generated by the first atomization assembly 51 and the vapor generated by the second atomization assembly 53, gather at the vapor gathering structure 30 and are inhaled by the user.

Figure 3:
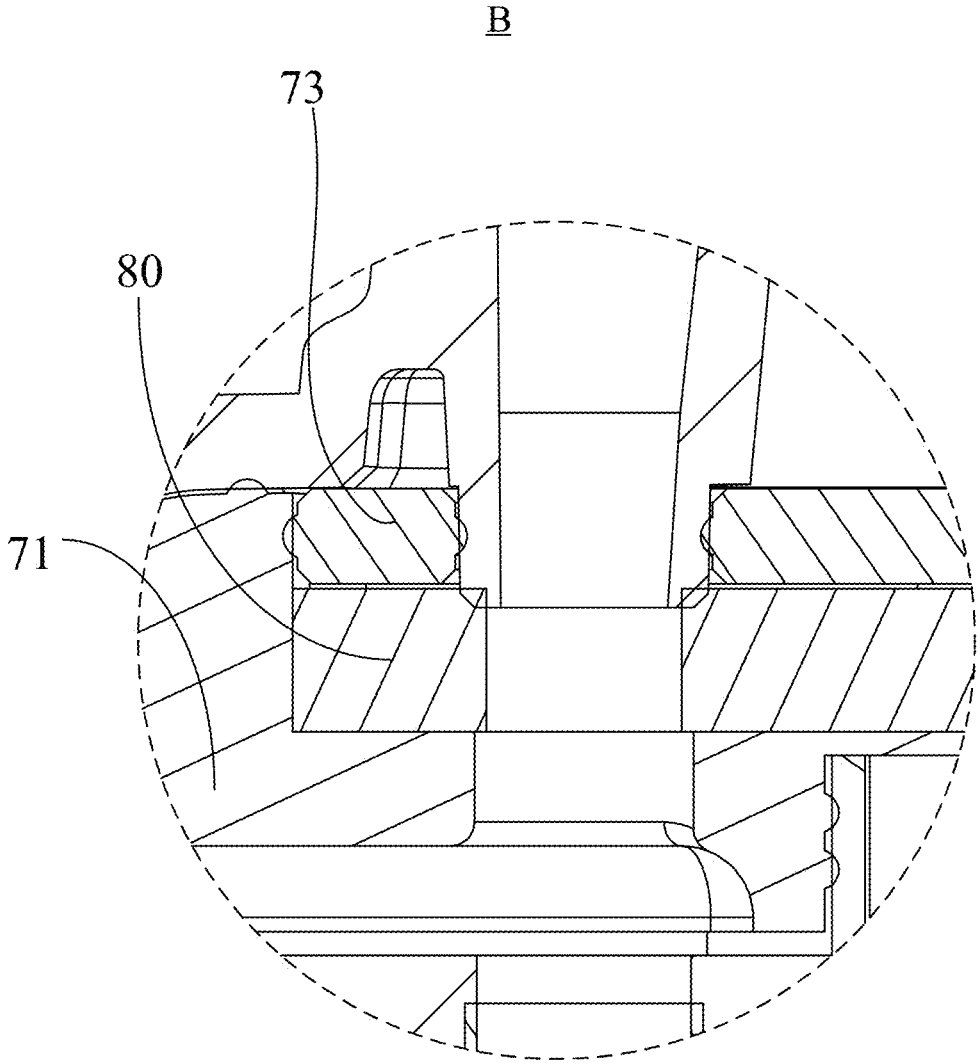
FIG. 3 is a partially enlarged view of part B in FIG. 1.
Figure 4:
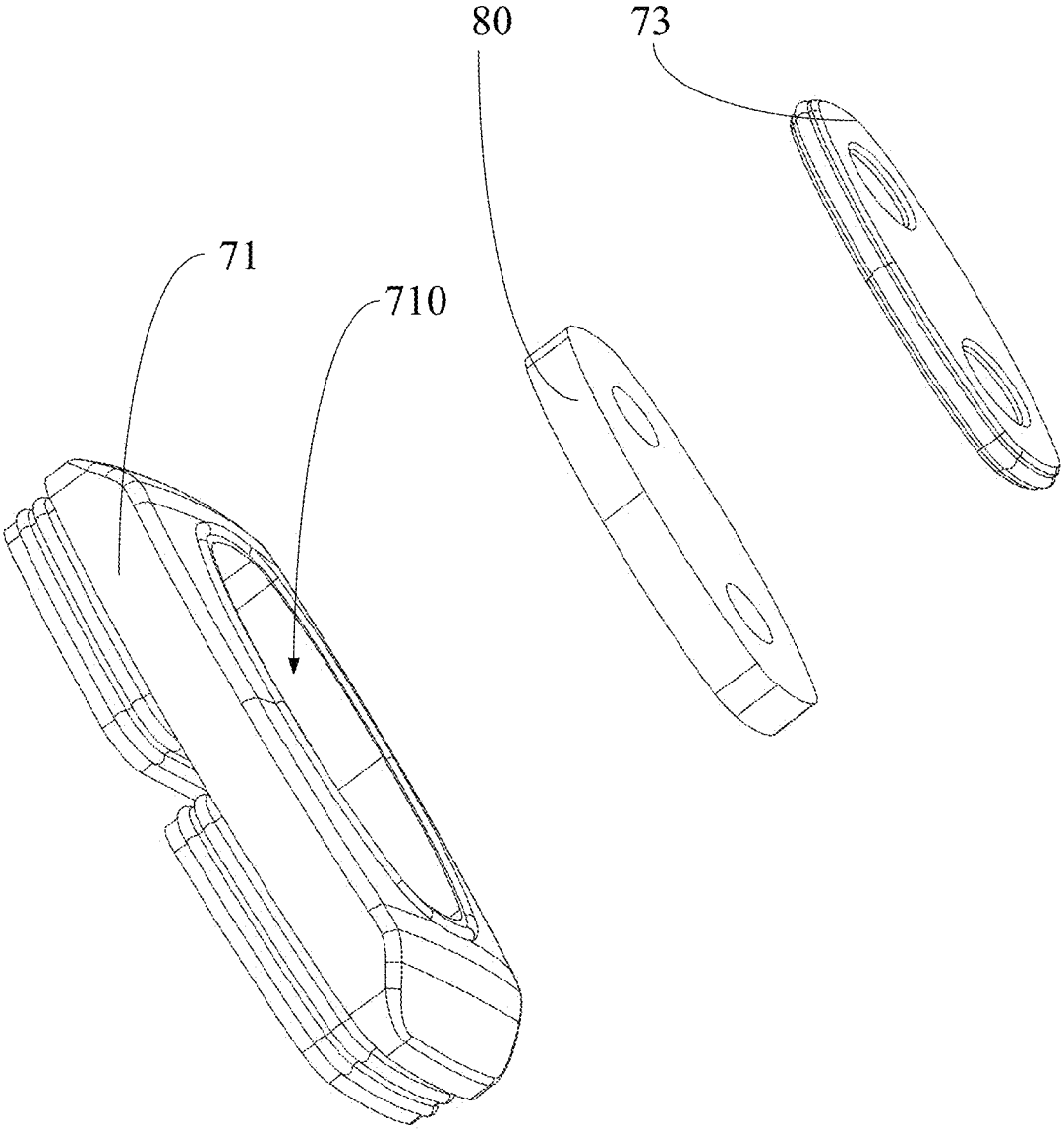
FIG. 4 is a structural schematic diagram of a first sealing member, a second sealing member, and a condensate absorbing structure in FIG. 1.
Figure 5:
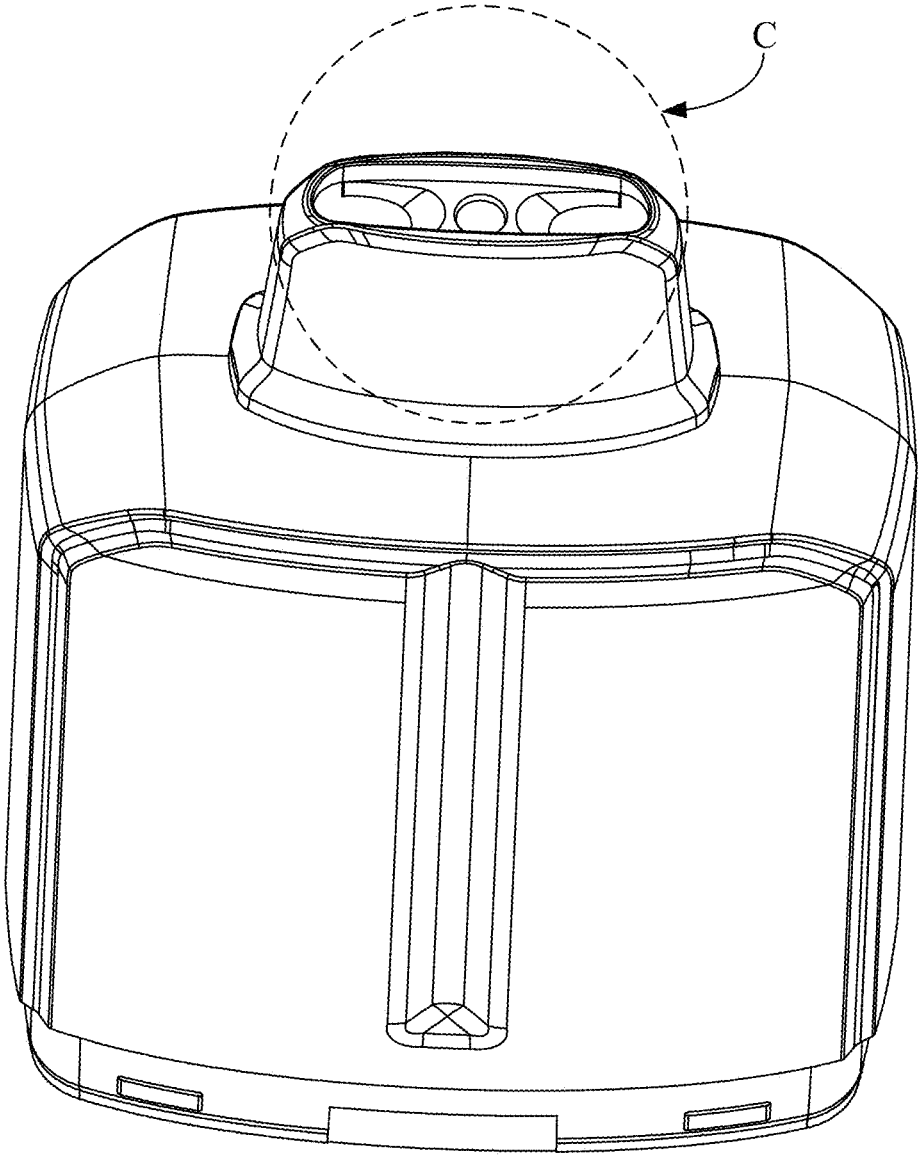
FIG. 5 is a structural schematic diagram of the vapor guiding structure and the vapor gathering structure in FIG. 1.

Referring to FIGS. 3 and 4, the atomization apparatus includes a first sealing member 71, the first sealing member 71 is located between the atomization assembly and the vapor guiding structure 10. A first through hole and a second through hole are formed in the first sealing member 71. The first channel is in communication with the first vapor discharging channel through the first through hole, and the second channel is in communication with the second vapor discharging channel through the second through hole. The first sealing member 71 serves to seal, ensuring that the vapor will not leak during the process of passing through the first channel 101 and the first vapor discharging channel 14 and that the vapor will not leak during the process of passing through the second channel 103 and the second vapor discharging channel 18. The first sealing member 71 may be made of soft adhesive, such as rubber, silica gel, or the like.

Referring to FIGS. 3 and 4, the atomization apparatus further includes a condensate absorbing structure 80, the condensate absorbing structure 80 is mainly used to absorb condensate. It can be readily understood, during the process of guiding the vapor to be discharged from the vapor discharging channels, the temperature of the vapor discharging channels is lower than that at the heating wire, and thus some of the vapor may be changed into the form of condensate due to the decrease in the temperature. Although it is referred to herein as condensate, it does not mean that the temperature thereof is acceptable to the user, the temperature of the condensate may exceed the user's acceptable level or even cause burns to the user. Therefore, the provision of the condensate absorbing structure 80 is conductive to further collect the condensate and avoid the vapor from being inhaled by the user. Thus, the effects of avoiding the user from getting burned, improving the taste of the vapor, and enhancing the user experience are achieved. The condensate absorbing structure 80 may be made of a material with good adsorption effect, such as cotton or non-woven fabric.

Below is the position relationship between the first sealing member and the condensate absorbing structure. A mounting groove 710 is formed in the first sealing member 71 at the side facing the vapor gathering structure 30. The condensate absorbing structure 80 is mounted at the mounting groove 710. The condensate absorbing structure 80 is used for absorbing the condensate generated in the first vapor discharging channel 14 and the second vapor discharging channel. As can be seen from FIG. 1, FIG. 3, and FIG. 4, two openings may be formed in the condensate absorbing structure 80, the two openings are in communication with the first vapor discharging channel 14 and the second vapor discharging channel, respectively. Thus, when passing through the condensate absorbing structure 80, the condensate in the vapor from the first vapor discharging channel 14 and the second vapor discharging channel is absorbed by the condensate absorbing structure 80, thereby preventing the condensate from being inhaled by the user.

In some embodiments, the condensate absorbing structure includes a multi-layer non-woven fabric structure. Specifically, the number of layers and weight of the non-woven fabric can be set according to actual requirements. In some embodiments, the condensate absorbing structure made by laminating six layers of 100*g* non-woven fabric has a good use effect. In conventional solutions, materials such as cotton (generally a single piece of cotton) are generally used to adsorb the condensate. Compared to the structure of the single piece of cotton, in the multi-layer non-woven fabric structure, there are more gaps among fibers, and thus the multi-layer non-woven fabric structure is capable of adsorbing more condensate, and also is capable of adsorbing the condensate faster. Moreover, the multi-layer non-woven fabric structure does not weaken the fragrance and sweetness of the vapor. Furthermore, the liquid storage cotton in the atomization assembly such as the first atomization assembly 51 and the second atomization assembly may also be made by the multi-layer non-woven fabric structure. In this way, the material of the condensate absorbing structure is the same as the material of the liquid storage cotton in the atomization assembly such as the first atomization assembly 51 and the second atomization assembly, which is conductive to assemble and reduce cost.

Referring to FIGS. 3 and 4, a second sealing member 73 is further included. The second sealing member 73 is mounted at the mounting groove 710, and located on the side, close to the vapor guiding structure 10, of the condensate absorbing structure. The second sealing member 73 may be made of soft adhesive, such as rubber, silica gel, or the like. The second sealing member 73 is located on the side, close to the vapor guiding structure 10, of the condensate absorbing structure, so as to prevent the condensate absorbed by the condensate absorbing structure 80 from being inhaled by the user.

The vapor guiding structure further includes a housing 111 in which the first vapor discharging channel and the second vapor discharging channel are located. To enhance the aesthetics of the atomization apparatus, the housing may be made of a transparent material, such as a transparent polymeric material. The first sealing member is made of opaque material and may be made of a colored soft adhesive, such as a colored silica gel, rubber, or the like. The second sealing member is made of an opaque material and may be made of a colored soft adhesive, such as a colored silica gel, rubber, or the like.

According to an aspect, structures, such as the condensate absorbing structure inside the atomization apparatus, can be covered by the first sealing member and the second sealing member made of an opaque material. Moreover, by configuring the housing with a transparent material, colors of the first sealing member and the second sealing member can be seen by the user. Thus, by changing the colors of the first sealing member and the second sealing member, the style of the atomization apparatus is changed.

According to another aspect, an embodiment of the present disclosure further provides an aerosol generating apparatus including an atomization apparatus according to any of the embodiments and examples described above and a power supply apparatus. The atomization apparatus is electrically connected to the power supply apparatus, and the power supply apparatus is used to supply power to the atomization apparatus.

In the aerosol generating apparatus, the atomization apparatus according to any of the above-described embodiments and examples is used, and thus the effects of the atomization apparatus according to any of the above-described embodiments and examples are obtained, which will be omitted herein.

Different embodiments describe the present disclosure from different perspectives. For parts that are not discussed in a particular embodiment, please refer to the relevant descriptions in other embodiments.

In the description of the present disclosure, the terms "first" and "second" are used for descriptive purposes only and are not to be construed as indicating or implying relative importance or implying the number of indicated technical features. Thus, a feature defined by "first" and "second" indicate or imply one or more of the features.

The atomization apparatus and the aerosol generating apparatus provided in the embodiments of the present disclosure have been described in detail. Specific examples are provided to explain principles and operations of the subject disclosure. The description of the above embodiments is merely provided to help understand the method of the present disclosure and the key ideas thereof. At the same time, variations will be made to those skilled in the art in both the detailed description and the scope of disclosure in accordance with the teachings of the present disclosure. In summary, the present description should not be construed as limiting the disclosure.

What is claimed is:

1. An atomization apparatus comprising:

a vapor guiding structure, a first vapor discharging channel and a second vapor discharging channel being formed in vapor guiding structure; and a vapor gathering structure, the vapor gathering structure being in communication with both the first vapor discharging channel and the second vapor discharging channel, a vapor discharging port being formed in the vapor gathering structure, and the vapor gathering structure being configured to gather vapor passing through the first vapor discharging channel and vapor passing through the second vapor discharging channel, and guide a gathered vapor to be discharged from the vapor discharging port;

wherein, the first vapor discharging channel comprises a first end facing the vapor discharging port, the second vapor discharging channel comprises a second end facing the vapor discharging port, a cross-sectional area of the first end gradually decreases in a direction away from the vapor discharging port, and a cross-sectional area of the second end gradually decreases in the direction away from the vapor discharging port;

wherein the vapor guiding structure comprises a first side wall, a second side wall, a third side wall, and a fourth side wall, the second side wall and the third side wall are disposed between the first side wall and the fourth side wall, the second side wall is disposed obliquely from the vapor gathering structure toward a direction away from the vapor gathering structure and toward a direction away from the fourth side wall, the third side wall is disposed obliquely from the vapor gathering structure toward the direction away from the vapor gathering structure and toward a direction away from the first side wall, the first vapor discharging channel is formed by the first side wall and the second side wall, and the second vapor discharging channel is formed by the third side wall and the fourth side wall.

2. The atomization apparatus according to claim 1, wherein the first side wall and the fourth side wall are parallel to each other.

3. The atomization apparatus according to claim 1, wherein the first side wall and the second side wall are curved surfaces extending along an axis x-x of the atomization apparatus.

4. The atomization apparatus according to claim 1, wherein an angle between the second side wall and an axis x-x of the atomization apparatus is set to be 6 degrees~10 degrees; and/or an angle between the third side wall and the axis of the atomization apparatus is set to be 6 degrees~10 degrees.

5. The atomization apparatus according to claim 4, wherein the angle between the second side wall and the axis x-x of the atomization apparatus is equal in size to the angle between the third side wall and the axis x-x of the atomization apparatus.

6. The atomization apparatus according to claim 4, wherein the angle between the second side wall and the axis x-x of the atomization apparatus is different in size from the angle between the third side wall and the axis x-x of the atomization apparatus.

7. The atomization apparatus according to claim 1, wherein a vapor gathering space is formed in the vapor gathering structure, the vapor gathering structure comprises an annular convex edge and a bottom wall, one end of the annular convex edge is connected to the bottom wall, and an opposite end of the annular convex edge extends in a direction away from the bottom wall to form the vapor discharging port, a first vapor inlet opening and a second vapor inlet opening are formed at intervals in the bottom wall, the first vapor discharging channel is in communication with the vapor gathering space through the first vapor inlet opening, and the second vapor discharging channel is in communication with the vapor gathering space through the second vapor inlet opening.

8. The atomization apparatus according to claim 7, wherein the annular convex edge comprises a first convex edge, a second convex edge, a third convex edge, and a fourth convex edge connected in sequence, and wherein the first convex edge and the third convex edge are disposed opposite to each other, and the second convex edge and the fourth convex edge are disposed opposite to each other.

9. The atomization apparatus according to claim 8, where a distance between the second convex edge and the fourth convex edge is smaller than a distance between the first convex edge and the third convex edge.

10. The atomization apparatus according to claim 7, wherein the vapor gathering structure further comprises a first guiding wall connected between the second side wall and the bottom wall, the first guiding wall extends obliquely from the second side wall to the bottom wall in a direction toward the fourth side wall so as to guide the vapor in the first vapor discharging channel toward a direction close to the second vapor discharging channel; and/or, the vapor gathering structure further comprises a second guiding wall connected between the third side wall and the bottom wall, the second guiding wall extends obliquely from the third side wall to the bottom wall in a direction toward the first side wall so as to guide the vapor in the second vapor discharging channel toward a direction close to the first vapor discharging channel.

11. The atomization apparatus according to claim 10, wherein an angle between the first guiding wall and an axis x-x of the atomization apparatus is greater than an angle between the second side wall and the axis x-x of the atomization apparatus.

12. The atomization apparatus according to claim 10, wherein an angle between the second guiding wall and an axis x-x of the atomization apparatus is greater than an angle between the third side wall and the axis x-x of the atomization apparatus.

13. The atomization apparatus according to claim 7, wherein a groove is further formed in the bottom wall, and the groove is located between the first vapor inlet opening and the second vapor inlet opening.

14. The atomization apparatus according to claim 1, further comprising an atomization assembly, and first and second channels locating at one side, away from the vapor gathering structure, of the vapor guiding structure, wherein the atomization assembly includes a first atomization assembly and a second atomization assembly, the first channel is in communication with the first vapor discharging channel, the second channel is in communication with the second vapor discharging channel, the first atomization assembly is mounted at the first channel, and the second atomization assembly is mounted at the second channel.

15. The atomization apparatus according to claim 14, wherein each of the first atomization assembly and the second atomization assembly includes a heating wire, a liquid storage cotton, and a liquid cup, liquid substance to be atomized in the liquid cup enters the liquid storage cotton, and the liquid substance to be atomized in the liquid storage cotton is heated by the heating wire.

16. The atomization apparatus according to claim 15, wherein the substance to be atomized in the liquid cup of the first atomization assembly is different in taste from the substance to be atomized in the liquid cup of the second atomization assembly.

17. The atomization apparatus according to claim 14, further comprising a first sealing member, a condensate absorbing structure, and a second sealing member, wherein the first sealing member is located between the atomization assembly and the vapor guiding structure, a first through hole and a second through hole are formed in the first sealing member, the first channel is in communication with the first vapor discharging channel through the first through hole, and the second channel is in communication with the second vapor discharging channel through the second through hole, and wherein a mounting groove is formed in the first sealing member at one side facing the vapor gathering structure, the condensate absorbing structure is mounted to the mounting groove, the condensate absorbing structure is configured to absorb condensate generated in the first vapor discharging channel and the second vapor-discharging channel, and wherein, the second sealing member is mounted to the mounting groove and is located on one side, close to the vapor guiding structure, of the condensate absorbing structure, and the condensate absorbing structure comprises a multi-layer non-woven fabric structure.

18. The atomization apparatus according to claim 17, wherein the vapor guiding structure further comprises a housing, the first vapor discharging channel and the second vapor discharging channel are located in the housing, and the housing is made of a transparent material; the first sealing member is made of an opaque material, and the second sealing member is made of an opaque material.

19. An aerosol generating apparatus, comprising an atomization apparatus and a power supply apparatus, the power supply apparatus being electrically connected to the atomization apparatus, wherein the atomization apparatus comprises:

a vapor guiding structure, a first vapor discharging channel and a second vapor discharging channel are formed in the vapor guiding structure; and a vapor gathering structure, the vapor gathering structure being in communication with both the first vapor discharging channel and the second vapor discharging channel, a vapor discharging port being formed in the vapor gathering structure, the vapor gathering structure being configured to gather vapor passing through the first vapor discharging channel and vapor passing through the second vapor discharging channel together and guide a gathered vapor to be discharged from the vapor discharging port;

wherein, the first vapor discharging channel comprises a first end facing the vapor discharging port, the second vapor discharging channel comprises a second end facing the vapor discharging port, a cross-sectional area of the first end gradually decreases in a direction away from the vapor discharging port, and a cross-sectional area of the second end gradually decreases in the direction away from the vapor discharging port;

wherein the vapor guiding structure comprises a first side wall, a second side wall, a third side wall, and a fourth side wall, the second side wall and the third side wall are disposed between the first side wall and the fourth side wall, the second side wall is disposed obliquely from the vapor gathering structure toward a direction away from the vapor gathering structure and toward a direction away from the fourth side wall, the third side wall is disposed obliquely from the vapor gathering structure toward the direction away from the vapor gathering structure and toward a direction away from the first side wall, the first vapor discharging channel is formed by the first side wall and the second side wall, and the second vapor discharging channel is formed by the third side wall and the fourth side wall.

* * * * *